US008627649B2

(12) United States Patent
Peters

(10) Patent No.: US 8,627,649 B2
(45) Date of Patent: Jan. 14, 2014

(54) DEVICE AND METHOD FOR METERING LIQUID POLLUTANT-REDUCING MEDIA INTO AN EXHAUST GAS DUCT OF AN INTERNAL COMBUSTION ENGINE

(75) Inventor: Axel Peters, Freising (DE)

(73) Assignee: Audi, AG, Ingolstadt (DE)

( * ) Notice: Subject to any disclaimer, the term of this patent is extended or adjusted under 35 U.S.C. 154(b) by 360 days.

(21) Appl. No.: 12/598,144

(22) PCT Filed: Mar. 12, 2008

(86) PCT No.: PCT/EP2008/001947
§ 371 (c)(1),
(2), (4) Date: Oct. 29, 2009

(87) PCT Pub. No.: WO2008/135112
PCT Pub. Date: Nov. 13, 2008

(65) Prior Publication Data

US 2010/0132344 A1 Jun. 3, 2010

(30) Foreign Application Priority Data

May 4, 2007 (DE) ..... 10 2007 020 812

(51) Int. Cl.
*F01N 1/00* (2006.01)
*F01N 3/10* (2006.01)

(52) U.S. Cl.
USPC ..... 60/286; 60/295; 60/324

(58) Field of Classification Search
USPC ..... 60/286, 295, 324
See application file for complete search history.

(56) References Cited

U.S. PATENT DOCUMENTS

| | | | | |
|---|---|---|---|---|
| 6,367,320 | B1 * | 4/2002 | Kueper et al. | 73/114.71 |
| 6,401,449 | B1 * | 6/2002 | Hofmann et al. | 60/274 |
| 6,509,049 | B1 * | 1/2003 | Parsons et al. | 426/250 |
| 6,623,155 | B1 * | 9/2003 | Baron | 366/181.5 |
| 7,571,603 | B2 * | 8/2009 | Ripper et al. | 60/286 |
| 2007/0178025 | A1 * | 8/2007 | Opris | 422/177 |
| 2007/0245718 | A1 | 10/2007 | Cheng et al. | |

FOREIGN PATENT DOCUMENTS

| | | | |
|---|---|---|---|
| DE | 19741199 | A1 | 4/1999 |
| DE | 19922959 | A1 | 7/1999 |
| DE | 19806265 | C1 | 11/2000 |
| DE | 102005063081 | A1 | 7/2007 |
| DE | 102006058715 | B3 | 1/2008 |
| DE | 102006049531 | A1 | 4/2008 |
| EP | 0894523 | A | 2/1999 |
| EP | 1712751 | A | 10/2006 |
| FR | 2906306 | A | 3/2008 |
| WO | WO 2006037710 | A1 * | 4/2006 |

* cited by examiner

*Primary Examiner* — Kenneth Bomberg
*Assistant Examiner* — Brandon Lee
(74) *Attorney, Agent, or Firm* — Novak Druce Connolly Bove + Quigg LLP

(57) ABSTRACT

The invention relates to a device and a method for metering liquid pollutant-reducing media into an exhaust gas duct of an exhaust gas line of an internal combustion engine, with at least one metering means which is located in or on the exhaust gas duct and downstream to which, viewed in the flow direction of the exhaust gas upstream from a catalytic converter arrangement, a baffle body is connected such that the liquid which has been metered by means of the metering means strikes a baffle body for its distribution. According to the invention the baffle body is formed by a static mixer which has a plurality of preferably single-blade guide vane plates which project away from the mixer plane at a given angle and which are aligned such that the metered liquid, especially liquid droplets, strikes the plane of the guide vane plates essentially perpendicularly.

4 Claims, 2 Drawing Sheets

DEVICE AND METHOD FOR METERING LIQUID POLLUTANT-REDUCING MEDIA INTO AN EXHAUST GAS DUCT OF AN INTERNAL COMBUSTION ENGINE

The invention relates to a device for metering liquid pollutant-reducing media into an exhaust gas duct of the exhaust gas line of an internal combustion engine, a method for metering liquid, pollutant-reducing media into an exhaust gas duct of the exhaust gas line of an internal combustion engine and a static mixer.

BACKGROUND OF THE INVENTION

The generic DE 10 2004 048 075 A1 discloses a device and a method for metering liquid, pollutant-reducing media into an exhaust gas duct of the exhaust gas line of an internal combustion engine in which by means of a metering device located in an exhaust gas duct the liquid is injected in the form of one or more string-shaped liquid jets, and these jets are to be directed at a baffle plate or baffle body in order to achieve the corresponding liquid distribution. Other details in this respect are not disclosed. Alternatively, it is provided that the liquid be injected by means of a spray nozzle, the so-called injection site being located in the curve region of an exhaust gas duct. In this version there is no baffle plate or baffle body.

A similar structure is also known from DE 197 41 199 C2 in which the reducing agent is injected within the pipe elbow of an exhaust gas duct. Upstream and downstream from the elbow is one static mixer at a time which is made as an expanded grating with a number of meshes formed by intermediate bridges. With this static mixer the exhaust gas flow in the exhaust gas duct is to be made uniform.

Furthermore U.S. Pat. No. 6,905,658 B2 discloses a structure in which the exhaust gas duct in front of the inlet to the actual catalytic converter is divided into a plurality of individual flow channels, each of these flow channels being assigned its own metering means for the reducing agent.

Conversely, the object of this invention is to make available a device and a method for metering liquid, pollutant-reducing media, such as, for example, ammonia or urea, into an exhaust gas duct of the exhaust gas line of an internal combustion engine as well as a static mixer by means of which extremely fine distribution or atomization of the liquid, pollutant-reducing media to be metered becomes easily and reliably possible.

SUMMARY OF THE INVENTION

According to a first aspect of this invention, the baffle body is formed by a static mixer which has a plurality of preferably single-blade guide vane plates which project away from the mixer plane at a given angle and which are aligned such that the metered liquid strikes the plane of the guide vane plates essentially perpendicularly.

With this execution of a static mixer an especially effective, extremely fine distribution of the metered liquid which can be, for example, ammonia or urea is achieved, since the perpendicular incidence of the liquid, preferably of liquid droplets, leads to the desired fine atomization of the liquid. This effective fine atomization of the liquid droplets which have injected, for example, by means of a spray nozzle in conjunction with the plurality of guide vane plates enables an especially uniform distribution of the metered reducing agent in the exhaust gas flow; this again then enables especially effective reduction of pollutants in the catalytic converter, especially within the scope of so-called selective catalytic reduction (SCR) in which the NOx conversion takes place in a lean atmosphere by way of specially made catalytic converters. That is, that in conjunction with the solution according to the invention the liquid droplets which have already been injected anyway by means of a spray nozzle, for example, can be easily and reliably atomized again for extremely fine distribution in the exhaust gas flow. For metering the reducing agent, durable, heavy-duty spray nozzles can also be used which have a nozzle head which makes available a larger droplet size and therefore does not clog as easily as would being the case in special nozzles which enable extremely fine atomization with the corresponding special nozzle heads.

Fundamentally the metering of liquid droplets is preferred in order to be able to undertake a first extremely fine distribution within the framework of metering by way of the metering means. But it is also fundamentally possible not to meter the liquid drop by drop, but in the form of one or more liquid jets which can them likewise be atomized upon perpendicular impact on the planes of the guide vane plate.

According to one especially preferred configuration of the invention it is furthermore provided that the guide vane plates of the static mixer are essentially aligned the same, i.e., essentially have the same extension direction, by which it can be easily ensured that the liquid droplets deflected or entrained by the exhaust gas flow in any region of the static mixer can perpendicularly strike the plane of the guide vane plate of the static mixer in order to achieve the desired atomization of the injected liquid droplets.

According to another preferred configuration of the invention it is further provided that the guide vane plates all are made identically and/or are tilted against the plane of the mixer with an identical tilt angle. This static mixer can be easily manufactured and at any site of the static mixer delivers the same atomization conditions. Preferably the tilt angle of the guide vane plate against the mixer plane is in the range between 20° to 80°, preferably between 40° and 60°.

The guide vane plates according to another preferred configuration relative to the mixer plane are arranged in several rows of guide vanes, the individual rows of guide vanes and/or the individual guide vane plates of a row of guide vanes having a given, preferably identical distance from one another. Thus a reliable static mixer which is altogether very simple to produce with single-blade vanes is made available.

The mixer itself, according to another preferred configuration of the invention, can have a support grating which lies in the mixer plane, consisting of grating braces aligned at a right angle to one another, the support grating having a plurality of essentially rectangular, in particular square grating openings which are separated from one another by the grating braces and which lie next to one another. The guide vanes themselves on the opening side are coupled to a grating brace region which forms the opening side wall and project away from it in single vanes or scale-like and/or blade-like, tilted in a given direction. In particular, here the guide vane plate is formed by an essentially planar and/or rectangle-shaped vane plate, by which perpendicular impact of the liquid droplets or liquid jet can be achieved especially easily. But fundamentally slightly arched configurations of the individual guide vane plates are also possible; this, however, in turn means increased production costs. The static mixer itself can be produced from a metal and/or plastic material, and the guide vane plates can be coupled on the support grating, for example, by welding or the like.

The mixer itself preferably has an outer ring which is closed in a ring shape and in which the support grating is formed. This outer ring is connected at least in certain sections to one wall of the exhaust gas duct, preferably in a flat contact connection. This contact connection is produced, for example, by welding.

According to another aspect according to the invention, the metering means is located in or on the exhaust gas duct such that the liquid metered by this metering means, especially the liquid droplets injected by a metering means which is designed as a spray nozzle, are deflected by the exhaust gas flow such that these, for example, liquid droplets perpendicularly strike the plane of the plate of guide vanes. For this purpose, the metering means is preferably located in the region of the pipe elbow, preferably in or on the outer curved wall region of this pipe elbow of the exhaust gas duct so that the liquid is injected or sprayed in the direction to the plane of the static mixer and/or the liquid droplets have a ballistic, i.e. convexly curved flight path. In this way outstanding atomization results are achieved. The liquid or liquid droplets are metered in this connection in a controlled manner by way of a control means.

According to one especially preferred configuration, the metering means is located in a targeted manner in conjunction with the static mixer such that a ballistic flight path is impressed onto the liquid jet or liquid droplets, especially by deflection by means of the exhaust gas flow such that the liquid jets or liquid droplets strike the guide vane plates perpendicularly in their "sinking flight phase", by which especially effective extremely fine atomization is enabled.

A specific structure is especially preferred in which the guide vane plates viewed in the direction of the vertical axis of the vehicle project to the top away from the mixer plane since here then the guide vane plates in the optimum manner have a vertical impact surface for the liquid jets or liquid droplets which have a natural flight path.

DETAILED DESCRIPTION OF THE PREFERRED EMBODIMENTS OF THE INVENTION

Figure 1:
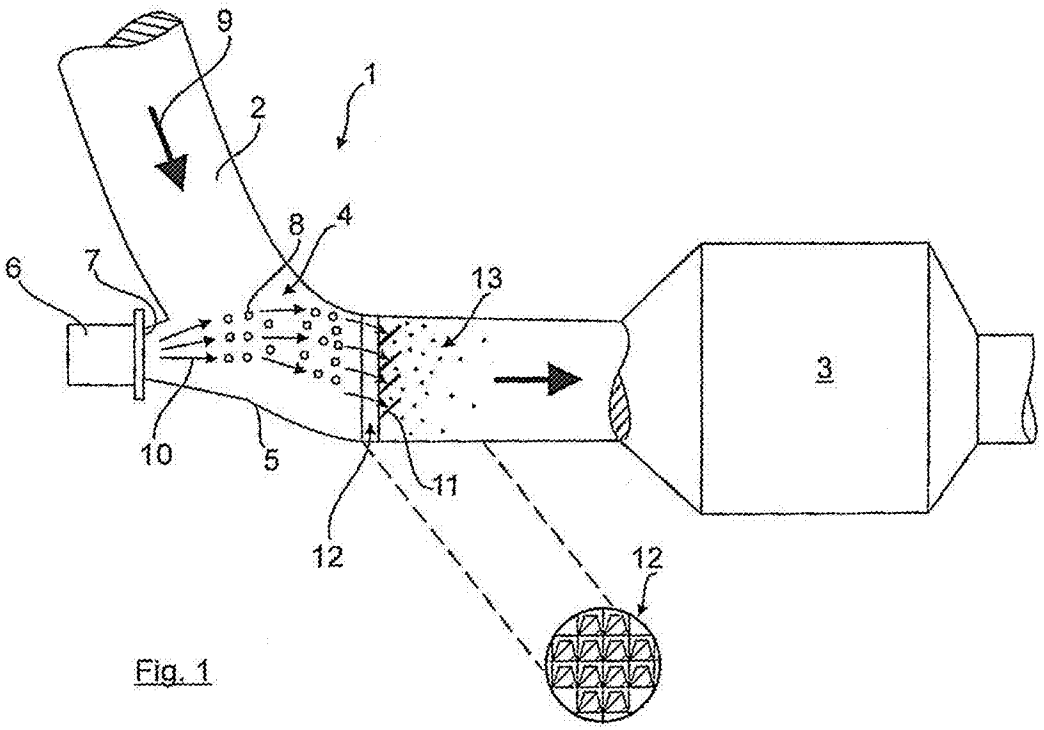
FIG. 1 schematically shows a device according to the invention for metering liquid, pollutant-reducing media into an exhaust gas duct of an exhaust gas line of an internal combustion engine of a motor vehicle.

FIG. 1 schematically shows a partial region of the exhaust system 1 of an internal combustion engine, in particular the diesel engine of a motor vehicle, which has an exhaust gas duct 2 which discharges into a SCR catalytic converter 3. The exhaust gas duct 2 in the region in front of the SCR catalytic converter has a curved region as a pipe elbow 4 in whose outer curved wall region 5 there is a metering valve 6 which is connected to a control device which is not shown here and furthermore has a spray nozzle arrangement 7 by means of which a liquid reducing agent, such as, for example, urea or ammonia, is injected in droplet form, i.e., as liquid droplets 8, into an exhaust gas flow 9 originating from the internal combustion engine.

As can be taken from the schematic in FIG. 1, the injected liquid droplets 8 are deflected by the exhaust gas flow 9 such that they have a ballistic flight path and finally strike the flat single-blade guide vane plates 11 of the static mixer 12 essentially perpendicularly, as a result of which the liquid droplets 8 are extremely finely atomized, as is designated with reference number 13. This liquid mist which has been extremely finely distributed in the exhaust gas flow 9 then travels into the SCR catalytic converter 3, where, as a result of the uniform, extremely fine distribution of the reducing agent effective selective catalytic reduction takes place. Metering takes place here such that the spray jet points essentially in the direction of the static mixers 12.

As is likewise schematically shown in FIG. 1*a*, the injected liquid, as a result of deflection by the exhaust gas flow 9 thus perpendicularly strikes the projected surface of the static mixer 12, which is formed by the guide vane plates 11.

Figure 3:
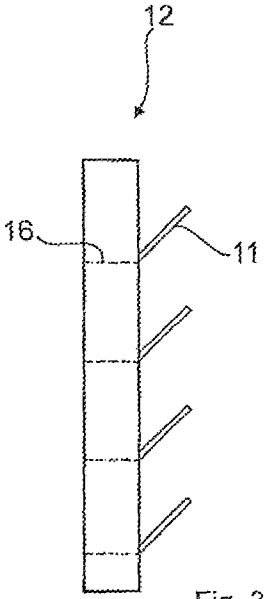
FIG. 3 shows a schematic side view of the static mixer of FIG. 2.
Figure 2:
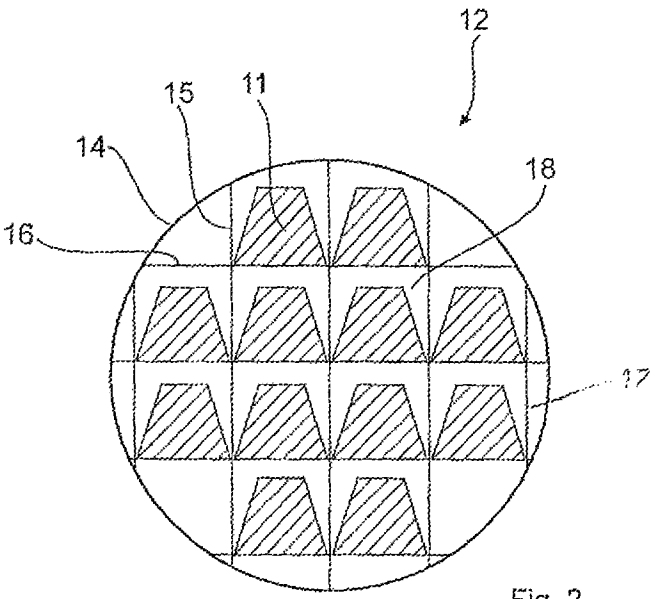
FIG. 2 shows an enlarged top view of the static mixer according to the invention.

This static mixer 12 is shown in detail in FIGS. 2 and 3 in a top view (FIG. 2) and in a side view (FIG. 3). As can be taken from the two figures, this static mixer 12 has an outer ring 14 which is closed in a ring shape, here with a round ring contour which is made accordingly to match the geometry of the exhaust gas duct 2. This outer ring 14 is preferably welded to the exhaust gas duct 2 such that this outer ring 14 with its outer side in a two-dimensionally peripheral contact connection flatly adjoins the exhaust gas duct 2, i.e., the inner peripheral surface of the exhaust gas duct 2.

In the outer ring 14 a support grating 15 of grating braces 16, 17 which are aligned at a right angle to one another and which form essentially square grating openings 18 is held. As can be taken especially from FIG. 2, the grating openings 18 which border the outer ring 14 are no longer made with a square grating opening geometry since the outer ring 14 here has a round ring-shaped contour and, accordingly, interrupts or cuts the square shape.

The individual guide vane plates 11 which are each made single-blade here, by an essentially flat, rectangular vane plate are coupled in the region of the side wall of the grating openings 18 which is formed by the grating braces 16, 17, and project away from there tilted in a given direction. The tilt angle is between 20° to 80°, at most preferably between 40° to 60°, relative to the mixer plane.

As can furthermore be taken from FIGS. 2 and 3, the guide vane plates 11 of the static mixer 12 are all aligned identically, i.e., they all have a uniform extension direction, preferably, as can be taken from schematic FIG. 1, tilted up in the direction of the vertical axis of the motor vehicle. The guide vane plates 11 are all made identical and are tilted with an identical tilt angle against the mixer plane, the guide vane plates 11, as can especially be taken from FIG. 2, being arranged in several rows of guide vanes, such that the individual rows of guide vanes and the guide vane plates of each row of guide vanes have the same distance from one another.

The guide vane plates 11 in the projected top view of FIG. 2 do not cover the entire grating opening region of the individual grating openings 18, but taper proceeding from the coupling point on the grating braces to the free end. With this execution of the static mixer 12, outstanding, extremely fine atomization of the injected liquid as the reducing agent is achieved.

The invention claimed is:

1. An exhaust gas system for an internal combustion engine, comprising:

a conduit connected to said engine for conveying exhaust gases emanating from said engine, including a curved section;

a catalytic converter disposed in said conduit downstream of said curved section;

a nozzle disposed on said conduit functional to inject a fluid into a stream of exhaust gases flowing through the curved section of said conduit; and a plurality of said openings in said member, each provided with one of said guide vanes, each of said guide vanes is angled at the sane angle relative to the plane of said member a member disposed in said conduit between said curved section of said conduit and said catalytic converter, having at least one opening with a guide vane projecting from an edge of said opening and lying in a plane disposed at an angle relative to the axis of said conduit, wherein the path of exhaust gases passing though said curved section, entrained with injected fluid, impinge said vanes substantially perpendicularly atomizing said fluid.

2. A system according to claim 1 wherein said injected fluid is a substance reactant with a component of said exhaust gases upon traversing said catalytic converter.

3. A system according to claim 1 wherein said nozzle is aligned at an angle relative to the direction of flow of said stream of exhaust gases.

4. A system according to claim 1 wherein said openings are equally spaced in rows in a cross pattern.

* * * * *

UNITED STATES PATENT AND TRADEMARK OFFICE

CERTIFICATE OF CORRECTION

PATENT NO. : 8,627,649 B2
APPLICATION NO. : 12/598144
DATED : January 14, 2014
INVENTOR(S) : Peters It is certified that error appears in the above-identified patent and that said Letters Patent is hereby corrected as shown below:

In the Claims:

Claim 1, Column 5: line 3 – please replace the word "sane" with the proper word "same". The line should read "...angled at the same angle relative to the plane of said..."

Signed and Sealed this
Seventeenth Day of June, 2014

Michelle K. Lee

Michelle K. Lee
*Deputy Director of the United States Patent and Trademark Office*